US007222449B1

(12) United States Patent
Gourand et al.

(10) Patent No.: US 7,222,449 B1
(45) Date of Patent: May 29, 2007

(54) WALL-MOUNTED PICTURE DISPLAY DEVICE

(76) Inventors: Claude D. Gourand, 510 Arrons Way, Ortonville, MI (US) 48462; Robin Lynn Gourand-Gorris, 1883 Oakfield St., Ortonville, MI (US) 46462

( * ) Notice: Subject to any disclaimer, the term of this patent is extended or adjusted under 35 U.S.C. 154(b) by 0 days.

(21) Appl. No.: 10/666,170

(22) Filed: Sep. 19, 2003

Related U.S. Application Data

(60) Provisional application No. 60/412,178, filed on Sep. 20, 2002.

(51) Int. Cl.
*A47G 1/06* (2006.01)

(52) U.S. Cl. ..... 40/776; 40/124.2; 40/594; 40/765; 40/760

(58) Field of Classification Search ..... 40/124.2, 40/594, 765, 776, 760
See application file for complete search history.

(56) References Cited

U.S. PATENT DOCUMENTS

| | | | | |
|---|---|---|---|---|
| 2,152,881 | A | 4/1939 | Engel | |
| 2,942,723 | A * | 6/1960 | Shapery et al. | 206/84 |
| 3,673,724 | A * | 7/1972 | Bell et al. | 40/729 |
| 3,687,770 | A | 8/1972 | Chase | |
| 4,771,557 | A | 9/1988 | Bowman | |
| 4,783,354 | A * | 11/1988 | Fagan | 428/40.5 |
| 4,900,604 | A | 2/1990 | Martinez et al. | |
| 4,944,968 | A | 7/1990 | Wagner | |
| 5,025,581 | A | 6/1991 | Polzin | |
| 5,452,479 | A * | 9/1995 | Mostert | 2/195.1 |
| 5,620,764 | A | 4/1997 | Schwarz et al. | |
| 5,639,539 | A * | 6/1997 | DeProspero et al. | 428/195.1 |
| 5,655,323 | A | 8/1997 | Lassoff | |
| 5,850,705 | A | 12/1998 | Groh | |
| 5,974,715 | A | 11/1999 | Werner et al. | |
| 6,052,933 | A * | 4/2000 | Lytle | 40/711 |
| 6,263,603 | B1 | 7/2001 | Wildrick | |
| 6,289,615 | B1 | 9/2001 | Kytlica | |
| 6,379,765 | B1 | 4/2002 | Woods | |
| 6,694,650 | B2 * | 2/2004 | Brown | 40/124.2 |

OTHER PUBLICATIONS

"Wallpaper Wishes," cDecor.com Magazine, http://www.cdecor.com/magazine.Hamilton.asp, Nov. 2001.*
"DecorateThis.com," http://web.archive.org/web/20020610160659/http://decoratethis.com/ideas.htm, Jun. 10, 2002.*
"Enlargement," http://web.archive.org/web/20020616165217/decoratethis.com/images/Lumpkin_dining_room_after.jpg, Jun. 16, 2002.*

* cited by examiner

*Primary Examiner*—Gary C. Hoge
(74) *Attorney, Agent, or Firm*—John A. Artz, Esq.; Artz & Artz, P.C.

(57) ABSTRACT

A wall-mounted picture display device generally including a flat substrate and a transparent pocket. The substrate, which is preferably comprised of wall paper or a wall paper border, includes a permanent or non-permanent adhesive layer on a rear surface such that the display device may be attached to a wall, ceiling or other surface without the use of nails, tacks, etc. Likewise, the transparent pocket includes a permanent or non-permanent adhesive layer on a rear surface for attachment to the substrate. In use, the display device provides for easy insertion or removal of a display object, such as a photograph, picture, postcard, memento, etc., without having to detach the display device from the wall.

11 Claims, 2 Drawing Sheets

WALL-MOUNTED PICTURE DISPLAY DEVICE

This application claims the benefit of U.S. Provisional Application No. 60/412,178 filed Sep. 20, 2002.

FIELD OF THE INVENTION

The present invention generally relates to a device for displaying photographs, pictures, post cards, mementos, and other objects. More specifically, the present invention relates to a wall-mounted display device having a substrate and a transparent picture pocket for receiving the object to be displayed.

BACKGROUND OF THE INVENTION

It is already known in the prior art to provide a transparent device for the display of photographs, pictures, post cards, mementos, and other objects. For instance, U.S. Pat. No. 4,771,557 issued Sep. 20, 1988 to Bowman and U.S. Pat. No. 4,944,968 issued Jul. 31, 1990 to Wagner each discloses such a device. Moreover, it also known in the prior art to provide a wall decorating system having pictorial cutouts removably adhered to a flat, wall-mounted background. U.S. Pat. No. 4,900,604 issued Feb. 13, 1990 to Martinez et al. and U.S. Pat. No. 5,620,764 issued Apr. 15, 1997 to Schwarz et al. disclose examples of such wall decorating systems. However, the prior art is characterized by certain structural and functional limitations which allow for improvement in the art.

For example, there is a need in the art to provide a picture display device for displaying a picture or other object on a wall. Such a device should allow for the easy removal and replacement of displayed objects, such that a person may quickly and easily exchange the displayed object without having to remove the display device from the wall. Additionally, there is a need in the art for a wall-mounted picture display device capable of being attached to a wall without the use of nails, thumbtacks, pins, or other mechanical fastening devices. Such a device would be ideal for the display of objects in a setting, such as a college dormitory room, where the displays are only intended to be temporary.

Thus, it would be advantageous to provide an improved wall-mounted picture display device that allows for easy insertion of the object to be displayed, as well as easy attachment of the display device to the wall.

SUMMARY OF THE INVENTION

The above-noted shortcoming of prior art display devices, as well as shortcomings not specifically mentioned, are overcome by the present invention which generally provides a picture display device for exhibiting a display object. The picture display device includes a generally flat substrate having a surface that is in contact with an adhesive layer such that the display device is capable of being attached to a wall, and a generally flat pocket having a surface that is in contact with an adhesive layer such that the pocket can be secured to the substrate. When the picture display device is attached to the wall, the display object may be inserted or removed from the pocket without detaching the display device from the wall.

According to another embodiment, the picture display is largely the same as the embodiment of the preceding paragraph, however, the generally flat pocket is replaced by a thin piece of transparent material such that a pocket is formed between the substrate and the transparent material.

According to yet another embodiment, the picture device includes a plurality of either flat pockets or pieces of transparent material such that the picture display device is capable of accommodating a plurality of display objects.

Furthermore, both the adhesive layer contacting the substrate and the wall and the adhesive layer contacting the pocket and the substrate may either be of a permanent or a non-permanent nature.

DESCRIPTION OF THE DRAWINGS

The advantages and features of the present invention will be readily apparent with reference to the appended description and drawings, wherein.

DETAILED WRITTEN DESCRIPTION AND BEST MODE

Figure 1:
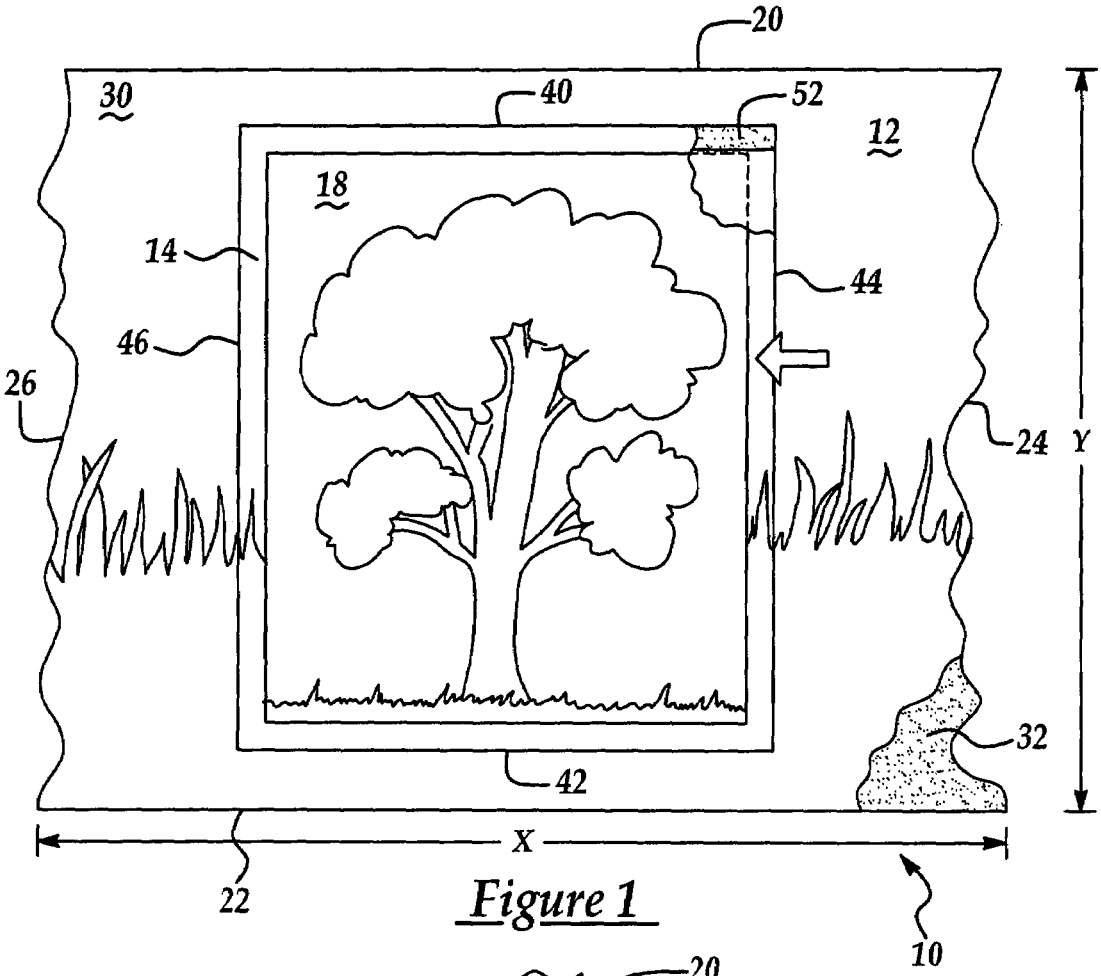
FIG. 1 is an elevation view showing an embodiment of the picture display device of the present invention, wherein a single object is displayed.

Referring now to the drawings, there is shown a wall-mounted picture display device for the convenient display of photographs, pictures, postcards, mementos, and other objects, hereafter simply referred to as 'display objects.' The wall-mounted picture display device of the present invention easily attaches to a surface, such as a wall or ceiling, and provides for the easy removal and replacement of display objects without having to detach the device from the wall. It will be appreciated, as the description proceeds, that the invention is useful in other embodiments and for other applications.

Figure 2:
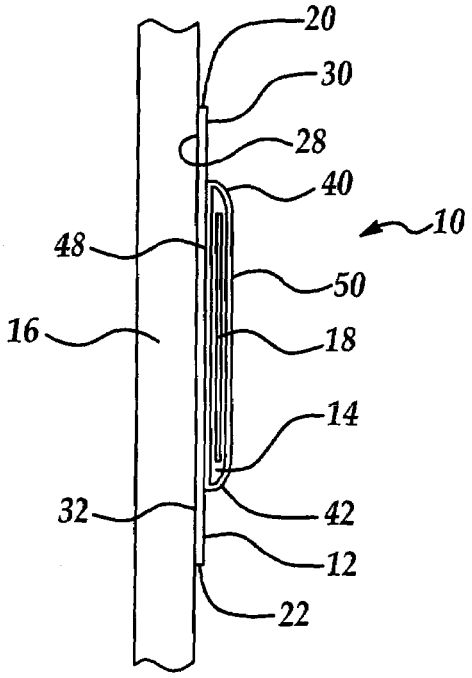
FIG. 2 is a side view showing the picture display device of FIG. 1.

With reference to FIGS. 1 and 2, the wall-mounted picture display device 10 of the present invention generally includes a flat substrate 12 and a transparent picture pocket 14. Substrate 12 both provides a surface to which the transparent picture pocket 14 can attach, and attaches the overall picture display device 10 to a surface 16, such as a wall or ceiling. The flat substrate 12 can be constructed from any number of materials, including materials already known in the art, such as wall paper, wall paper border, wall paper posters, poster board, construction paper, etc., or from materials especially developed for the present invention. Furthermore, substrate 12 can be comprised of either a flexible material for attachment to a curved surface, or a rigid material having greater structural integrity. Generally, substrate 12 is a flat component defined by a top edge 20, a bottom edge 22, a right edge 24, a left edge 26, a rear surface 28, and a front surface 30.

The particular embodiment exemplified in FIG. 1 shows a substrate 12 having a definite, predetermined height, that is, the distance Y between edges 20 and 22, and an indefinite, undetermined length, the distance X between edges 24 and 26. According to this embodiment, the substrate 12 is initially provided in a roll or other form having an indefinite length, where its eventual length X is determined by cutting a section from the initial roll. Conversely, this embodiment has a definite, predetermined height Y, which is precut such that the roll from which substrate 12 is provided has a uniform height along its entire length. It should be noted, however, that this is only one embodiment of substrate 12, as the substrate could just as easily be constructed having lengths and heights differing from those shown. For instance, the substrate could be provided with a length X and height Y that were both of a predetermined distance, such that the substrate constituted a precut rectangle having predetermined dimensions. Furthermore, the height and length of substrate 12 shown in FIG. 1 could be switched, such that the height was of an indefinite, undetermined distance and the length was of a definite, predetermined distance. It is also possible to provide substrate 12 such that both the length X and the height Y are of an indefinite and undetermined nature, thereby requiring a person to cut both of these dimensions. Also, the various edges 20–26 can be diverging, converging, wavy, jagged, cut with a particular pattern, etc. Stated differently, substrate 12 of the present invention may be provided having one of numerous shapes, the embodiment shown in FIG. 1 is simply one of them.

Rear surface 28 is provided with an adhesive layer 32 for attaching the substrate, and hence the entire picture display device 10, to wall 16. Adhesive layer 32, which can be seen in the cutaway portion of FIG. 1, may be of either a permanent or non-permanent nature. In the permanent adhesive embodiment, an adhesive with a high degree of tack is used to permanently attach the picture display device 10 to the wall. For instance, adhesive similar to that used for hanging wall paper could be utilized. Alternatively, in the non-permanent adhesive embodiment, an adhesive with a medium or low degree of tack is used to removably attach the display device 10 to the wall. Thereby, allowing for easy removal or repositioning of the display device 10 without causing damage to the wall. The non-permanent embodiment is especially useful in scenarios where a person wishes to decorate a room, such as a dormitory room, for a temporary period of time. Furthermore, the adhesive layer 32 could be directly applied to rear surface 28 using a spray or rolling process, or it could be in the form of a thin piece of two-sided adhesive tape. Also, the adhesive may be applied over the entire rear surface 28, as shown in the cutaway section, or it may be selectively applied, such as only around the perimeter of the substrate. The front surface 30 of the substrate provides a surface to which the transparent picture pocket 14 may attach itself. The particular front surface embodiment shown in FIG. 1 includes a pictorial design, blades of grass in this example, but could be one of an infinite number of designs. Furthermore, the design could be part of a common "motif," such that the substrate and display object 18 were of a corresponding theme. The front surface 30 could simply be a solid color, a decorative design, or any other appropriate depiction. Regardless of the particular aesthetic characteristics of front surface 30, it is intended to receive transparent picture pocket 14.

Picture pocket 14 is constructed of a transparent material, such as a thin, flexible plastic material, and is designed to slidably receive a display object 18. According to the embodiment shown in FIG. 2, the picture pocket 14 includes a top edge 40, a bottom edge 42, a right edge 44, a left edge 46, a rear layer 48, and a front layer 50. As with substrate 12, the various dimensions of the picture pocket 14 may vary extensively in order to accommodate objects of various sizes and shapes. Thus, the rather square like embodiment seen in FIG. 1 is simply an example of one embodiment. As is known in the art, rear layer 48 and front layer 50 are preferably melted, fused or otherwise joined together along three of the four edges 40–46 to form a pocket for receiving display object 18. Obviously, it would present problems if the one non-joined edge was the bottom edge 42, as the object would simply slide out of the pocket. However, any other combination of the edges could be joined in order to retain an object 18. For instance, the top edge 40 could be left non-joined such that the object could be inserted from the top. Likewise, either the right edge 44 or left edge 46 of the front and rear layers 48, 50 could be left non-joined to allow for slidable insertion from the side. Also, it is possible to only have two of the four edges, preferably the top and bottom edges 40, 42 joined, such that object 18 could be inserted from either side. The particular embodiment shown in FIG. 1 provides for insertion of the display object from the right side, as indicated by the solid arrow.

One side of rear layer 48 is in contact with an adhesive layer for attaching the transparent picture pocket 14 to substrate 12. That adhesive may either be of a permanent or a non-permanent nature. As previously discussed, use of an adhesive of a permanent nature does not permit the picture pocket to be removed, repositioned, adjusted, etc. from substrate 12. An adhesive layer of a permanent nature includes those examples where a separate, permanent adhesive is applied in between the picture pocket and the substrate, as well as those examples where a portion of the picture pocket is melted such that the melted material fuses to the substrate, thus forming a solidified adhesive layer. Use of a non-permanent adhesive layer, on the other hand, allows for the quick and easy removal, addition, or repositioning of the picture pocket 14 to the substrate 12 without causing damage to either the substrate or the picture pocket. It should be noted, however, that instead of having an adhesive applied to rear layer 48, the adhesive could alternatively be applied to front surface 30 of substrate 12. The rear layer 48 shown here is transparent in nature, as can be seen by the transparency between the outer edge of display object 18 and the perimeter of the picture pocket 14. It is possible, though, that rear layer 48 could be a solid color, preferably a color complimentary to either the front surface 30 of the substrate or the display object. In that case, the portion of the rear layer 48 not covered up by the display object 18 would act as a sort of background or border surrounding the perimeter of the display object.

Figure 3:
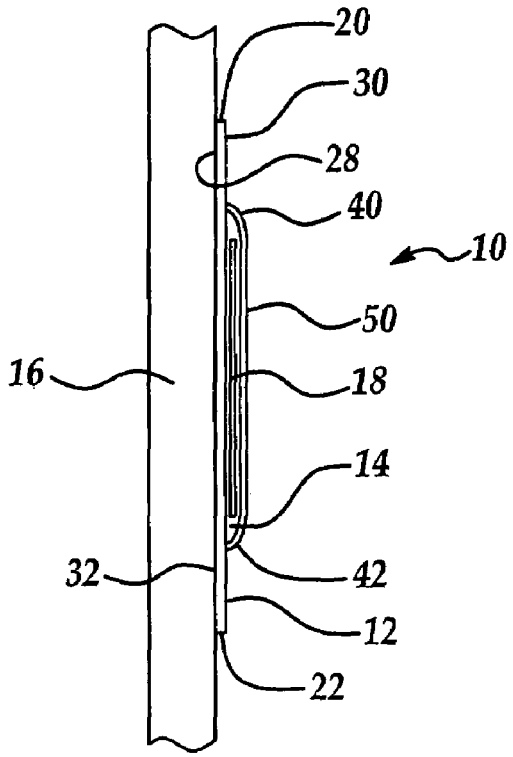
FIG. 3 is a side view showing the picture display device of FIG. 1 having a picture pocket constructed according to a different embodiment than that of FIG. 2.

FIG. 3 shows another embodiment of the picture pocket 14 which is largely the same as that previously described, but lacks a rear layer 48. A pocket for retaining the displayed object 18 is simply formed by directly adhering, melting or fusing two or three edges of a single piece of thin transparent material, such as front layer 50, to the substrate 12. As with the previous embodiment, it is possible to adhere different combinations of edges to form the desired pocket. For instance, in the embodiment shown in FIG. 1, a cutaway section shows an adhesive strip 52 extending along top edge 40. This adhesive strip does not extend downward along right edge 44. Rather, it provides an opening or slit along the right edge through which object 18 can be inserted. It is possible, however, to alternatively leave the top edge 40, the left edge 46, or a combination thereof open instead of the right edge shown in this example. Furthermore, the adhesive layer, shown here as strip 52, can either be comprised of a separate adhesive material inserted between the picture pocket and the substrate, or it can be formed from melted picture pocket material that solidifies to adhere the two components together.

Figure 4:
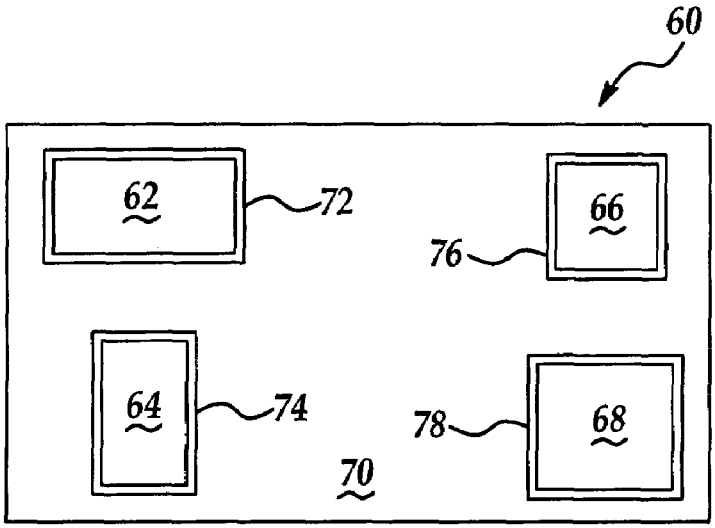
FIG. 4 is an elevation view showing an additional embodiment of the picture display device of the present invention, wherein numerous objects are displayed.

FIG. 4 shows an additional embodiment of the wall-mounted picture display device 60 of the present invention which is designed to display multiple display objects 62–68.

Similar to the embodiments previously discussed, the picture display device 60 includes a flat substrate 70 and several transparent picture pockets 72–78. Substrate 70 is largely the same as that previously discussed, thus, a second explanation has been omitted. Likewise, the transparent picture pockets 72–78 are similar to either of the two transparent picture pocket 14 embodiments previously discussed. The embodiment shown in FIG. 4 has primarily been included to demonstrate that numerous transparent picture pockets 72–78 could be attached to a single substrate 70. Picture display device 60 could be designed such that the substrate and the attached objects all portray a common theme, or they could be random objects that are unrelated.

In use, the wall-mounted picture display device 10 may either be permanently or non-permanently attached to a wall, ceiling, or other surface. Once attached, one is able to insert and remove display objects without having to detach and take down the picture display device 10. Furthermore, in the embodiment where the adhesive layer located between the transparent picture pocket 14 and the substrate 12 is non-permanent, the picture pocket can be rearranged, removed, added, etc. without having to detach and take down the picture display device 10 from the wall.

Although the description of this invention has been given with reference to particular embodiments, it is not to be construed in a limiting sense. Many variations and modifications will be apparent to those skilled in the art.

The invention claimed is:

1. A display device for exhibiting pictures on a wall or other surface comprising:

an elongated substrate member being supplied in a roll-type form, and adapted to be used as a border member on a wall or other surface, the substrate member having a definite length and a definite height;

said substrate member having a front surface and a rear surface, said rear surface of said substrate member having an adhesive material thereon for securing said substrate member to a wall or other surface;

said front surface of said substrate member having a pictorial design along the length thereof; and a plurality of picture pockets secured to said substrate member at predetermined intervals along the length thereof;

said picture pockets being made of a transparent material and having an opening therein for insertion of pictures or other display materials;

wherein when said elongate substrate member is unrolled and secured to a wall or other surface as a border member, said substrate member provides a pictorial design and a plurality of transparent pockets, and wherein when pictures or other display materials are inserted into said picture pockets, said pictures or other display materials are held in place and visible through the transparent material, and when there are no pictures or other display materials in said pockets, the pictorial design on the substrate member is visible through the transparent material.

2. The display device as set forth in claim 1 wherein said picture pockets comprise a single piece of transparent material.

3. The display device as set forth in claim 1 wherein said picture pockets are substantially rectangular and are secured on three edges to said substrate member.

4. The display device as set forth in claim 3 wherein said unsecured edges face in a direction toward an elongated edge of said substrate and are adapted to allow insertion of pictures or other display materials in said picture pockets.

5. The display device as set forth in claim 1 wherein said picture pockets have a front transparent member and a back transparent member, with said back transparent member being secured to said substrate member.

6. The display device as set forth in claim 5 wherein said openings in said picture pockets are along edges parallel to the upper elongated edge of said substrate member.

7. The display device as set forth in claim 1 wherein said adhesive material on said rear surface of said substrate member is a non-permanent adhesive such that said substrate member can be removed from said wall or other surface without damage thereof.

8. The display device as set forth in claim 1 wherein each of said pocket members are permanently secured to said substrate member.

9. The display device as set forth in claim 1 wherein a plurality of openings are provided in said picture pockets for insertion and display of pictures or other display materials.

10. The display device as set forth in claim 1 wherein said openings in said picture pockets comprise an open edge.

11. The display device as set forth in claim 1 wherein said substrate material on said roll can be cut to any length in order to be applied to a wall or other surface.

* * * * *